US006955353B2

(12) United States Patent
Taylor et al.

(10) Patent No.: US 6,955,353 B2
(45) Date of Patent: Oct. 18, 2005

(54) UNIVERSAL LOTTERY GAME TICKET AND A LOTTERY GAME AND A METHOD OF PLAYING THE LOTTERY GAME USING THE TICKET

(75) Inventors: Alan Taylor, Lancashire (GB); Andrew P. Gray, Halifax (GB)

(73) Assignee: Europrint Holdings Limited (GB)

( * ) Notice: Subject to any disclaimer, the term of this patent is extended or adjusted under 35 U.S.C. 154(b) by 0 days.

(21) Appl. No.: 09/808,329

(22) Filed: Mar. 14, 2001

(65) Prior Publication Data

US 2002/0130464 A1 Sep. 19, 2002

Related U.S. Application Data

(63) Continuation-in-part of application No. 09/794,266, filed on Feb. 27, 2001.

(51) Int. Cl.[7] ..... A63B 67/14

(52) U.S. Cl. ..... 273/113; 463/17; 463/1; 463/47

(58) Field of Search ..... 463/1, 16–22, 463/40–42; 46/47; 273/117, 138.1, 138.2, 139, 143 R, 269; 379/93.13, 93; 283/49, 51, 903

(56) References Cited

U.S. PATENT DOCUMENTS

| | | | | | |
|---|---|---|---|---|---|
| 4,725,077 | A | * | 2/1988 | Fujita | 283/67 |
| 4,943,090 | A | * | 7/1990 | Fienberg | 273/139 |
| 5,217,258 | A | * | 6/1993 | Sanderson | 283/105 |
| 5,265,880 | A | * | 11/1993 | Maksymec | 273/269 |
| 5,303,929 | A | | 4/1994 | Sandeen | |
| 5,433,448 | A | | 7/1995 | Raphael et al. | 273/241 |
| 5,580,059 | A | | 12/1996 | Marks | 273/271 |
| 5,624,119 | A | * | 4/1997 | Leake | 273/269 |
| 5,671,921 | A | * | 9/1997 | Quinlan | 273/139 |
| D389,193 | S | | 1/1998 | Rebish | D20/40 |
| 5,772,510 | A | * | 6/1998 | Roberts | 463/17 |
| 5,772,511 | A | * | 6/1998 | Smeltzer | 463/17 |
| 5,788,237 | A | * | 8/1998 | Fults et al. | 273/269 |
| 5,836,816 | A | | 11/1998 | Bruin et al. | |
| 5,855,514 | A | * | 1/1999 | Kamille | 463/17 |
| 5,927,716 | A | | 7/1999 | Goodson et al. | 273/269 |
| 6,220,596 | B1 | | 4/2001 | Horan | |
| 6,250,685 | B1 | * | 6/2001 | Walker et al. | 283/49 |
| 6,305,687 | B1 | * | 10/2001 | Pollock et al. | 273/269 |
| 6,347,794 | B2 | * | 2/2002 | Scrymgeour et al. | 273/138.1 |
| 6,457,714 | B1 | * | 10/2002 | Feola | 273/274 |
| 6,616,531 | B1 | * | 9/2003 | Mullins | 463/19 |
| 6,656,044 | B1 | * | 12/2003 | Lewis | 463/19 |
| 2002/0053597 | A1 | * | 5/2002 | Ehrhart et al. | 235/487 |

FOREIGN PATENT DOCUMENTS

| | | | |
|---|---|---|---|
| WO | WO 97/27921 | 8/1997 | A63F/9/24 |
| WO | PCT/US99/15320 | 7/1999 | |

OTHER PUBLICATIONS

U.S. Appl. No. 09/794,266, filed Feb. 27, 2001, Taylor et al.

* cited by examiner

*Primary Examiner*—Jessica Harrison
*Assistant Examiner*—Jason Skaarup
(74) *Attorney, Agent, or Firm*—
(74) *Attorney, Agent, or Firm*—le;.5qKenyon & Kenyon

(57) ABSTRACT

A novel lottery ticket as well as a lottery game and method of playing that game using the lottery ticket are disclosed. The lottery ticket can be used to participate in at least one of a plurality of drawing events that occur over a period of time. The lottery ticket comprises a number of panels that conceal a number of playing game pieces and/or free spaces. The playing game pieces and/or free spaces are concealed by a removable coating material. Participants can choose which drawing event to play, manifesting their intent to play a particular drawing event by revealing the playing game pieces associated with the panels that are designated specifically for that particular drawing event. The game is played further by selecting a combination of winning game pieces and determining whether any of each participant's playing game pieces match some or all of the winning game pieces. A ticket becomes a winning ticket if some or all of the matching playing game pieces on the lottery ticket adjoin so as to produce a winning line of a horizontal, vertical or diagonal "three-in-a-row" as with tic-tac-toe. More than one winning line are possible on each lottery ticket, producing multiple ways of winning on a single lottery ticket.

25 Claims, 6 Drawing Sheets

10

Instructions

Drawing Event: Lotto

1. Tune in to see which panels will be in play
2. Remove the Designated Panels
3. Watch as the winning pieces are drawn.
4. Match the drawn pieces to the uncovered pieces on your ticket
5. Three matching numbers horizontally, vertically or diagonally wins.

Drawing Event: Horseracing 9

1. Tune in to see which panels will be in play.
2. Remove the designated panels.
3. Watch horse racing and record the numbers of the first, second and third place horses.
4. Match the winning horses' numbers with the uncovered pieces on your ticket.
5. Three matching numbers horizontally, vertically or diagonally wins.

Drawing Event : Elite Eight College Basketball

1. Tune in to see which panels will be in play
2. Remove the designated panels
3. Watch the basketball games and record the scores of each winning team
4. Match the winning scores with the uncovered pieces on your ticket
5. Three matching numbers horizontally, vertically or diagonally wins.

Fig. 6

UNIVERSAL LOTTERY GAME TICKET AND A LOTTERY GAME AND A METHOD OF PLAYING THE LOTTERY GAME USING THE TICKET

REFERENCE TO RELATED APPLICATIONS

The present invention is a continuation in part application Ser. No. 09/794,266 entitled ONLINE LOTTERY GAME OF CHANCE AND METHOD OF AND SYSTEM FOR PLAYING THE GAME, that was filed with the United Stated Patent and Trademark Office on Feb. 27, 2001 with the application Ser. No. 09/794,266.

FIELD OF THE INVENTION

The present invention relates to a lottery ticket for a game of chance as well as to a lottery game and a method of playing that game using the lottery ticket. More precisely, the invention relates to a universal ticket for a lottery-type game of chance that can be used for drawing events occurring on a variety of different dates, and to a lottery game and to a method of playing that game, wherein the game comprising a plurality of participants any number of which can win at least one prize on the basis of a random drawing of game pieces selected from a population of game pieces.

DESCRIPTION OF THE RELATED ART

The gaming and lottery industry includes a myriad of various types of gaming, or lottery, tickets. However, in general, most lottery tickets fall into one of two categories: instant lottery tickets and traditional, i.e., draw, lottery tickets. Instant lottery tickets are purchased by game participants at a point of sale and can be played instantly, winning can be determined instantly, and, moreover, prizes can be awarded instantly. Play typically consists of either (i) scratching, or rubbing off, an opaque coating material from the surface of the lottery ticket, e.g., using a coin, or (ii) breaking open designated areas on the lottery ticket to reveal previously concealed game pieces and/or associated prizes. Similarly, game participants can purchase "draw"-type lottery tickets at a point of sale. However, the drawing event typically occurs at a date and/or time remote from the date and time of purchase. Unlike instant lottery tickets, though, a "draw"-type lottery event includes more than one participant.

UK Patent Application GB 2095567A to William Thomas Russell discloses an instant lottery-type ticket having first and second game information, which information is concealed beneath removable masking material. Game participants first remove masking material concealing the first game information, e.g., by rubbing the masking material with a coin. The first game information informs game participants which of the second game information should be revealed. Then game participants remove masking material concealing the second game information so identified. Prizes are awarded depending on the second game information revealed. Problems associated with this lottery-type ticket and game include that there is only one way to win on a particular card and that whether a card is a winning card is predetermined before the game information is concealed.

U.S. Pat. No. 5,074,566 to Desbiens discloses a two-level scratch game and ticket for playing the game, which game and ticket combine an instant lottery-type ticket with the familiar "draw"-type game of Bingo. Accordingly, game participants enjoy two ways of winning a prize. The lottery ticket according to Desbiens comprises a 5×5 first grid of boxes printed on a substrate. Each box of the first grid includes a unique playing game piece, which is concealed by a scratchable rub-off coating. One of more of the boxes of the first grid contain an instant prize, e.g., $2, $10, $100, etc. The remaining boxes contain numbers or other symbols.

A second grid, which is virtually identical to the first grid is printed on the scratchable rub-off coating. The second grid differs from the first grid, however, so that there is no indication of an instant prize.

The game is played at a drawing event at which a predetermined number of winning numbers are selected at random. Participants remove, e.g., rub-off, the scratchable coating of each winning number appearing on their game ticket. The first level of winning occurs by revealing at least one of the instant prizes. The second level of winning occurs if a combination of the winning game pieces produces a horizontal, diagonal, or vertical row of numbers akin to Bingo. A problem associated with this type of lottery ticket is that each lottery ticket is valid for a single, discrete drawing event, which is to say that the lottery tickets are dated, which produces waste and creates distribution problems.

As for lottery-type games, a majority of the states in the United States have legalized public and private lottery-type games. The most common format in state and multi-state lotteries is a game, e.g., LOTTO, THE BIG GAME, POWERBALL, etc., in which game participants select, or have automatically selected for them, a plurality of playing game pieces, e.g., typically between about three and eight numbers, from a population of game pieces, e.g., integers from 1 to 49. Game participants purchase lottery tickets for a few dollars at a point of sale terminal, which are frequently located in grocery stores, convenience stores, smoke shops, and elsewhere, with the expectation of winning a jackpot prize whose value often exceeds one million and sometimes tens of millions of dollars. Game participants either personally select their own combination of "lucky numbers" or, in the alternative, an electronic, random number generator, which is connected to a central server through a network, produces a combination of playing game pieces for them, e.g., by "quick pick".

The object of a lottery-type game is to match a game participant's playing game pieces with all or, in some instances, slightly less than all of a combination of winning game pieces, which are selected randomly in a lottery-type drawing. The odds of winning the game decrease, i.e., improve, significantly as the number of game pieces comprising the combination of winning game pieces increases. Lottery-type games are "linear", however, in that with each successive drawing of winning game pieces, more and more game participants are excluded from winning the top prize. As a result, typically, only a relatively small number of total game participants win any prize. As a result, prizes, e.g., cash jackpots, are usually large.

Lottery-type drawings typically comprise a manual or electronic random drawing device, which device selects a combination of winning game pieces from the game piece population. Manual lottery drawings comprise the step of randomly selecting winning game pieces, e.g., numbered ping pong balls, from a drawing machine or drum. Electronic random drawing devices generally comprise the steps of randomly generating a combination of winning game pieces from the game piece population using a server having a database and software therefor.

In many instances, the lottery-type drawing is televised live on commercial television, e.g., after the evening news.

In addition, results are typically published in local newspapers and posted at each point of sale. Game participants win the top, i.e., jackpot, prize if the combination of their playing game pieces exactly matches the combination of winning game piece drawn manually or generated electronically. Many lottery-type games, further, provide lesser prizes for matching most of the winning games pieces in the combination of winning game pieces. The dollar amount of the cash prize in these instances, however, is substantially smaller than the jackpot prize. When no one wins a particular drawing, the jackpot amount is carried over to the next drawing event.

A shortcoming associated with a lottery-type game includes its linearity, which rapidly excludes most game participants from winning anything. Indeed, with a lottery-type game there is virtually only one way to win the jackpot prize and/or lesser prizes and very few game participants can win.

A variation of the lottery-type game is a keno-type game, which also uses a population of game pieces, e.g., numbers 1 to 80, from which a combination of winning game pieces is selected at random, e.g., by an electronic, random number generator. Keno-type games typically appear on a video display or closed circuit television, which shows each winning game piece as it is generated and which authenticates every game after each drawing event. Keno-type games differ from lottery-type games in a number of ways. First, the total population of game pieces for keno-type games typically is larger than lottery-type game piece populations. Moreover, more winning game pieces are selected in each keno-type drawing event than are needed to win the top prize. As a result, game participants can lack some of the winning game pieces and still win the top prize. Indeed, more game participants can win some prize if not the top prize. Prizes, e.g., cash payoffs, however, typically are substantially smaller than lottery-type payoffs.

Furthermore, game participant can choose the number of winning game pieces that he or she will try to match, e.g., two, five, ten, etc. For example, if the total population of game pieces comprises 80 game pieces and 20 game pieces are selected per drawing event, a game participant who chooses to match ten game pieces can lack ten of the 20 winning game pieces and still win the top prize. However, the odds and, consequently, the dollar amount of cash prizes are greater when a game participant selects more playing game pieces to match the combination of winning game pieces. Shortcomings of keno-type game, though, include their inaccessibility to the general public and the game is not universally understood and play confuses some would-be participants.

Numerous U.S. and foreign patents have been issued to inventors for a variety of games and games of chance based on tic-tac-toe. Indeed, Patent Cooperation Treaty patent number WO 97/2791 to Marks et al. discloses an interactive tic-tac-toe game that is played between a pair of participants. The method of the game basically follows the conventional, simple tic-tac-toe format, which children throughout the world play. Indeed, the game of tic-tac-toe is simple and well understood: a plurality of X's and O's (or surrogate symbols therefor) are placed alternately in one of nine cells, or boxes, of a game board, or matrix, by one and then by the other participant. The object of the game, of course, remains getting three-in-a-row vertically, horizontally or diagonally before one's opponent. As a whole, however, the prior art has not advanced the simple child's game much beyond, e.g., a pencil and paper embodiment.

Interest and participation in current lottery-type games is often flat unless extraordinarily large cash jackpots accumulate following a series of weeks in which no one claims the cash jackpot. Furthermore, participants prefer simple games and simple formats. Moreover, new games of chance that are easily understood and provide for multiple winners are always in demand in the gambling and gaming industries.

SUMMARY OF THE INVENTION

Accordingly, it would be desirable to produce a novel, universal lottery ticket that can be used for any one of many drawing events of the game participant's choice, which occur during an established duration of time. Indeed, it also would be desirable to produce a novel game ticket for a game of chance based on a simple, well-known child's game (as well as the game and a method of playing the game using the ticket) to foster greater participation. Furthermore, it would be desirable to produce a lottery ticket, a game of chance, and a method of playing the game using the lottery ticket in which there are more than one possible combinations of winning game pieces on a single playing ticket, which allows more participants to win and, moreover, more winning combinations on a single ticket. Indeed, it would be desirable to produce a lottery ticket, a new game of chance, and a method of playing the game using the lottery ticket that differs from typical lottery- or keno-type games.

Therefore, it is an object of this invention to produce a novel game of chance and a method of playing the game that produce multiple possible winning combinations using some but not necessarily all of the winning game pieces on a single playing ticket.

It is a further object of this invention to produce a novel game of chance and a method of playing the game that allow more game participants to win.

It is another object of this invention to produce a novel game of chance and a method of playing the game the rules of which are easily understood to encourage more people to participate.

It is yet another object of the present invention to produce a novel game of chance and method of playing the game whose format differs from typical lottery- or keno-type games.

It is still another object of the present invention to produce a novel, universal lottery game ticket that does not have to be used for a predetermined drawing event, but, rather, that can be used in conjunction with a drawing event of the game participant's choice.

These and further objects are obtained by a novel lottery ticket that can be used to play, at a participant's discretion, in one of many potential drawing events, which events occur before the expiration date of the card. Moreover, these objects are obtained by a game of chance and a method of playing the game using the novel lottery ticket.

Accordingly, the present invention discloses a universal lottery ticket, which can be used to participate in any one of a plurality of lottery-type drawing events, the ticket comprising:

a substrate, having an obverse and a reverse side;

a plurality of playing game pieces, which are disposed on the obverse side of the universal lottery ticket in at least one array, the at least one array comprising a plurality of playing panels, each of the plurality of playing panels comprising a number of playing game pieces; and a removable material, having a surface, that is disposed over—so as to conceal—the plurality of playing game pieces, wherein a plurality of unique indicia is disposed on the surface of the removable material so that each of the plurality of unique indicia corresponds to only one of the plurality of playing panels.

Moreover, the present invention discloses a lottery game played by a number of participants, the game comprising:

a plurality of the above-described lottery tickets, a drawing event designation; and a random selection device, wherein said random selection device selects a plurality of winning game pieces.

The game is played, first, by designating a combination of playing panels on the ticket that are used to link the ticket to a particular drawing event, and then by randomly selecting or electronically generating a number of winning game pieces from the population of game pieces. Game participants are awarded, e.g., cash, prizes when randomly selected winning game pieces match a plurality of playing game pieces on a participant's playing ticket to produce at least one vertical column, horizontal row or diagonal of adjoining game pieces. Game participants win some prize for matching any number of the winning game pieces so long as the plurality of matching game pieces occurs "in-a-row."

BRIEF DESCRIPTION OF THE DRAWINGS

For a fuller understanding of the nature and desired objects of the present invention, reference is made to the following detailed description taken in conjunction with the accompanying drawing figures wherein like reference character denote corresponding parts throughout the several views and wherein:

FIG. 6 illustrates an example reverse side of the game ticket, according to an example embodiment of the present invention.

DETAILED DESCRIPTION OF THE INVENTION AND ITS PREFERRED EMBODIMENTS

Figure 1:
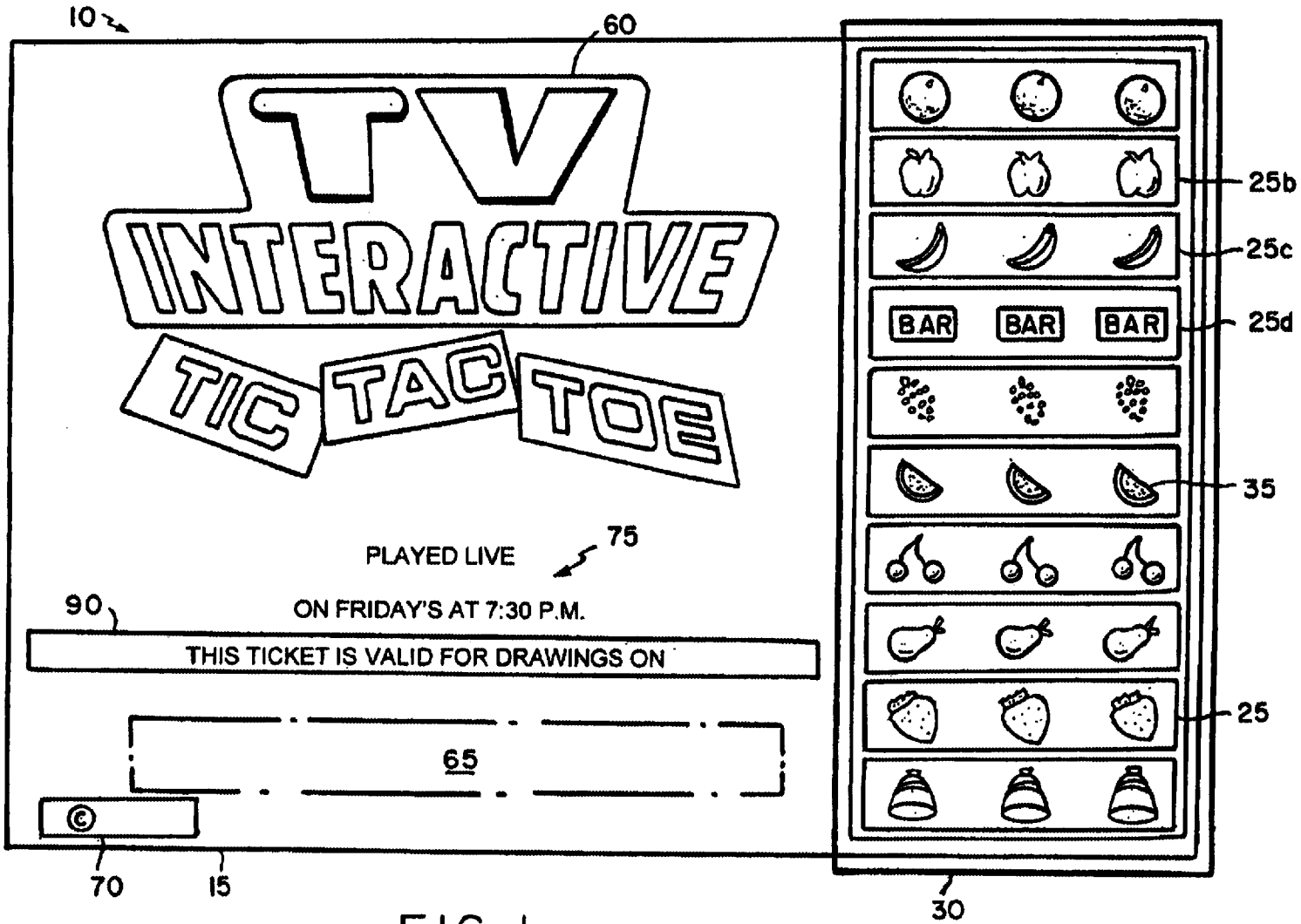
FIG. 1 is an illustrative embodiment of a masked game ticket.

The present invention relates to a universal playing ticket 10 for a game of chance based on tic-tac-toe and to a lottery game and a method of playing that game using the ticket 10. See FIGS. 1 and 2. The playing ticket 10 comprises a substrate 15 on which is printed or otherwise shown a number of playing game pieces 20. Playing game pieces 20 are disposed in, e.g., vertical panels 25 to produce a group of panels 30. For example, as shown in FIGS. 1 and 2, three playing game pieces 20 are disposed in ten vertical panels 25 to produce a group of panels 30 that comprises a total of thirty playing game pieces 20.

Figure 2:
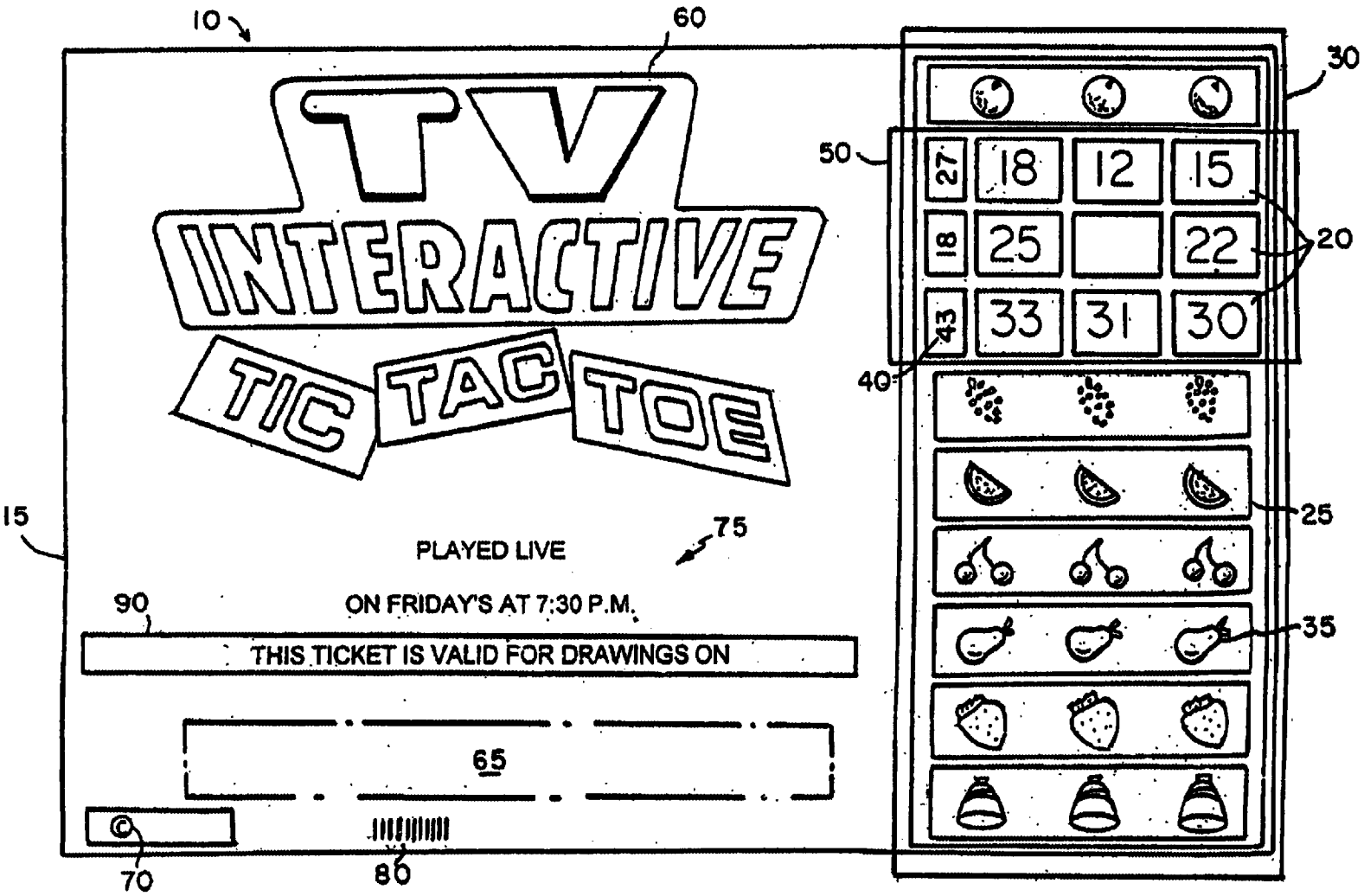
FIG. 2 is an illustrative embodiment of a game ticket with an exposed playing panel.

The playing game pieces 20 shown in the exemplary embodiment of FIGS. 1 and 2 are integers; however, the playing game pieces can be other types of symbols. Game piece panels 25 do not have to be disposed vertically on the playing ticket 10. Indeed, panels 25 can be disposed, e.g., horizontally without violating the scope and spirit of this disclosure.

A freespace 5 may also be included as a playing game piece. Furthermore, the number of panels 25 comprising the group of panels 30 on a playing ticket 10 does not have to be ten as shown and could be any number greater than or less than ten. Furthermore, the number of playing game pieces 20 in a panel 25 does not have to be three as shown in the figures. Preferably, the number of playing game pieces 20 in a panel 25 is at least three.

The group of panels 30 is masked with a removable, e.g., scratchable or erasable, opaque coating material of a type that is well known to those of ordinary skill in the art. The coating material conceals the playing game pieces 20 on each playing ticket 10 until the coating material has been scratched or rubbed off, e.g., with a coin, to reveal the playing game pieces 20 disposed thereunder. Preferably, printed on the coating material corresponding to each panel 25 are some indicia 35 that are unique to a particular panel 25. For example, FIGS. 1 and 2 depict panel indicia 35 comprising various fruits, bells, and bars. The nature of the panel indicia 35 is not critical to the practice of this invention; however, the indicia 35 should be distinctive for each panel 25 so that no indicia 35 for one panel 25 in a group 30 is substantially or confusingly similar to the indicia 35 of another panel 25 in the same group 30.

The substrate 15 of the playing ticket 10 can be made of paper or cardboard, or similar materials that are known to those skilled in the art. The playing ticket 10 also can have at least one of the following printed on its surface: the life of the playing card 90, the name of the game 60, general playing information 65, the owner of intellectual property rights to the game 70, the normal day of the week and time of the drawings associated with the playing ticket 75, and/or a validation symbol 80 for validating the authenticity of the playing ticket 10. Additionally, instructions for playing the game typically are provided on the reverse side of the playing ticket 10.

FIG. 6 illustrates instructions 9 for playing a game using various drawing events, according to an example embodiment of the present invention. The example instructions may be located on the back of game ticket 10.

Figure 3:
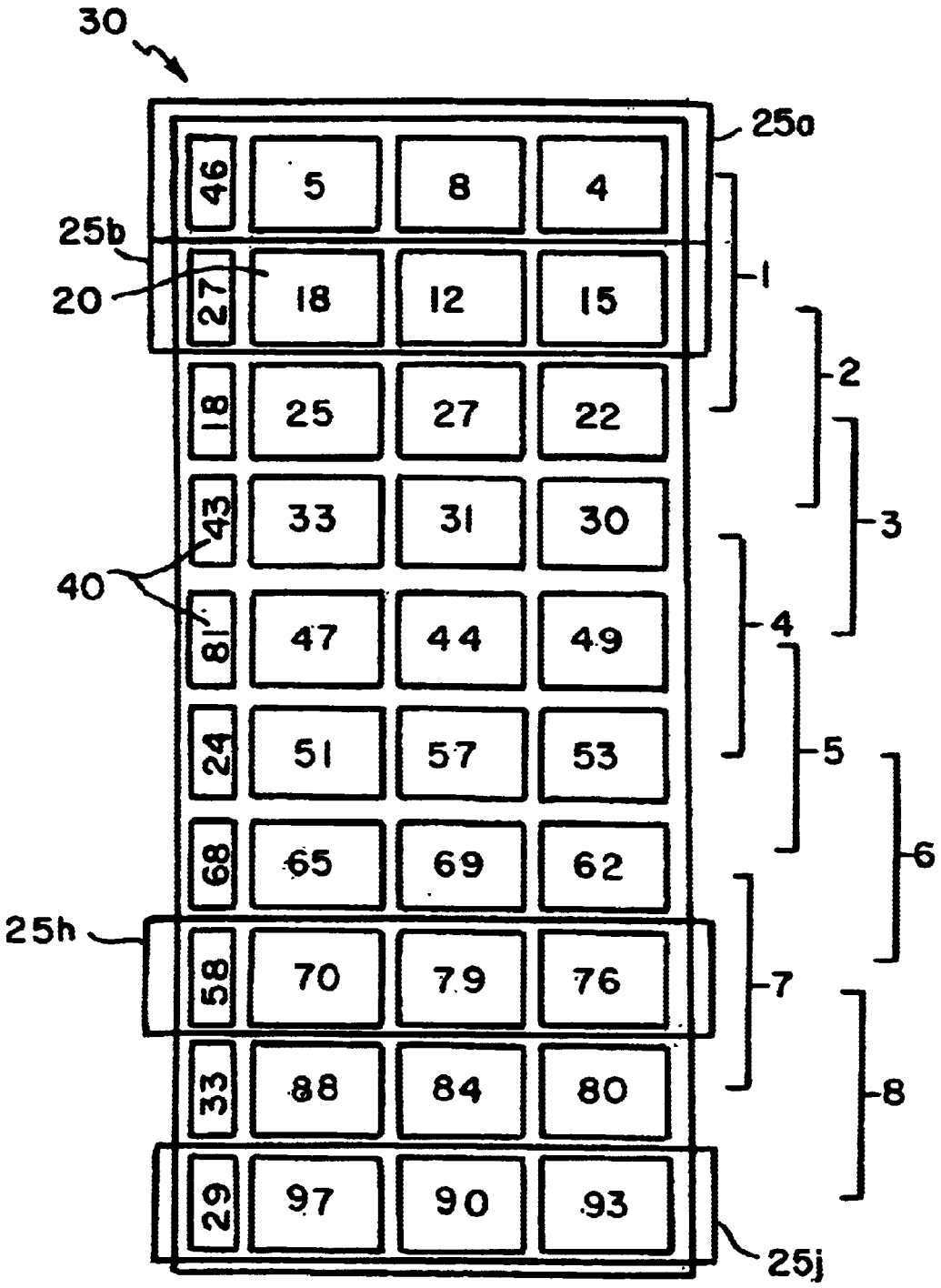
FIG. 3 is an illustrative embodiment of the distribution of playing game pieces in a group of panels.
Figure 5:
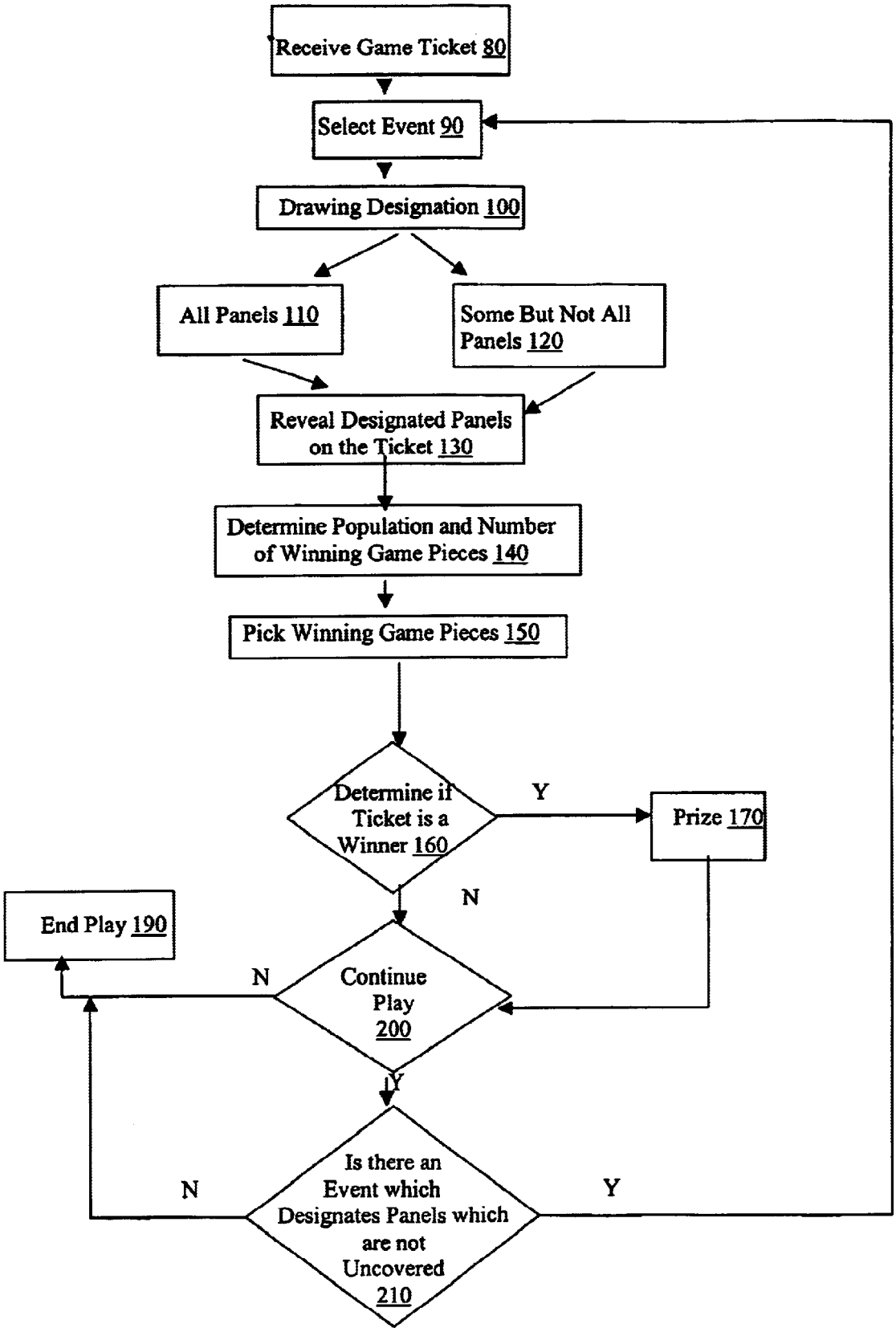
FIG. 5 illustrates an example method of playing a game, according to an example embodiment of the present invention.

An embodiment of the group of panels 30 will now be described in greater detail. FIG. 5 shows an example method for playing the game. At 80 game participants may receive a game ticket. At 90, the game participants may select a drawing event. At 100, the drawing designation of the selected event may tell the game participants which panels to remove and play. At 110, the drawing designation may have the game participants remove all of the panels on the game ticket. At 120, the drawing designation may specify that only some of the panels should be removed. At 130, the game participant may remove the designated panels on the game ticket. At 140, the gaming authority may determine the population and number of the winning game pieces. At 150, the gaming authority may select the winning game pieces at 150. At 160, whether the game ticket is a winner may be determined. At 170, a prize may be awarded to a winning ticket. At 200, game participants with a losing ticket may decide whether to continue play. If the game participants elected to play again, at 210, an event may designate panels not previously uncovered. Then, the game participants may select another event at 90. If the game participants does not wish to continue play at 200 or if there is not an event which designated panels not previously uncovered at 210, the play may end at 190. If a prize is awarded at 170, the game participants may still elect to play again at 200. See FIG. 3. It should be noted that the following description of the group of panels 30 is not meant to be limiting; rather, illustrative in nature. Indeed, FIG. 3 illustrates a group of panels 30 comprising ten panels 25. Each panel 25 contains a number of playing game pieces 20, which is shown as three in the figure. Also disposed in each panel 25 is a verification code 40, the use for which will be described below. Preferably, to preclude any confusion between the verification code 40 and the playing game pieces 20, the verification code 40 is of a smaller font and/or disposed in a direction orthogonal to the playing game pieces 20 (as shown in FIG. 3). The verification code 40 also can employ a different symbol than is used for playing game pieces 20 without violating the scope and spirit of this disclosure. For example, playing game pieces 20 can include integers and verification numbers 40 can include Roman numerals and/or letters.

Playing game pieces 20 are selected from a population of game pieces. Preferably, a range of game pieces 20 is allocated to each panel 25. For example, integers from 0 to 9 are allocated to the uppermost panel 25*a*, integers from 10 to 19 are allocated to the panel immediately below the uppermost panel 25*b*, and so on down to the lowermost panel 25*j* in which integers from 90 to 99 are allocated.

A lottery game and a method of playing that lottery game using the above-described playing ticket 10 will now be described. This game and method of playing the game can produce more winning participants per drawing event; can allow game participants to win prizes for matching fewer than all of the plurality of winning game pieces drawn at random; and, moreover, can provide each game participant with one or more possible winning combinations on a single playing ticket 10.

Furthermore, prizes, e.g., cash jackpots, can be calculated according to the total number of, e.g., horizontal, vertical and/or diagonal, winning lines L completed in a, e.g., three-by-three (3×3), playing panel 50 much like in a game of tic-tac-toe. See FIGS. 2 and 4. For example, a winning line L comprises any plurality of, e.g., at least three, adjoining playing game pieces 20 that match any of the game pieces comprising the combination of winning game pieces 55. Winning lines L can occur horizontally, vertically and/or diagonally.

The game is played by a plurality of game participants. Each game participant obtains one or more game ticket 10 from a point of sale terminal. In a preferred embodiment, the game ticket 10 is valid for a predetermined duration. Hence, the game ticket 10 is valid for play during any single drawing event that occurs during the life 90 of the playing ticket 10, i.e., before the playing ticket 10 expires. For example, preferably, each game ticket 10 has a life 90 of, i.e., will be valid for, eight drawing events, which events can occur daily, weekly, etc.

Once game participants have purchased their playing tickets 10, game participants are able to select which drawing event during the life 90 of the playing ticket 10 to play. Game participants manifest their intention to play their ticket 10 in conjunction with a particular drawing event by removing, e.g., rubbing off, the coating material of the panels 25 corresponding to that drawing event. Indeed, preferably, each drawing event during the life 90 of the playing ticket 10 designates a number of, e.g., three consecutive, panels 25, which become the playing panel 50. Accordingly, for one embodiment of a game ticket 10 having ten panels 25 in a group 30, there are eight possible combinations of three consecutive panels 50. See FIG. 3. Hence, the life 90 of the embodied playing ticket 10 corresponds to eight. In another embodiment, the life 90 of the playing ticket 10 is extendable for up to about 120 drawing events if playing panels 25 are not consecutive.

For example, a game participant purchases a game ticket 10 such as shown in FIG. 1. On a particular date and time within the life 90 of the playing card 10, the drawing event designates "apple-banana-bar" as the consecutive playing panels 50 prior to the random drawing. Participants who opt to play during a particular drawing event manifest their intention by removing, e.g., rubbing off, the coating material associated with the apple 25*b*, bar 25*c*, and banana panels 25*d*, revealing the participant's playing game pieces 20 thereunder. See FIG. 2.

This game and preferred method of playing the game of the present invention further comprises the steps of drawing or generating a plurality of winning game pieces 55 from the population of game pieces and determining the number of winning game tickets 10 and the number of winning lines L per winning game ticket 10 for each drawing event. Winning game pieces 55 can be selected, manually, e.g., using a manual drawing device, e.g., a drum; or generated electronically, e.g., using an electronic random number generator.

Preferably, the number of winning game pieces 55 drawn at random corresponds to the number of game pieces 20 exposed in the playing panels 50. However, more or fewer winning game pieces 55 can be drawn. Winning game pieces 55 are selected from the range of game pieces 20 that was allocated to each panel 25 in proportion to the number of game pieces 20 exposed in the panel 25. For example, three winning game pieces 55 are randomly selected from integers from 10 to 19, which integers are allocated to the "apple" panel 25*b*; three winning game pieces 55 are randomly selected from integers from 20 to 29, which integers are allocated to the "banana" panel 25*c*; and three winning game pieces 55 are randomly selected from integers from 30 to 39, which integers are allocated to the "bar" panel 25*d*. In all, nine winning game pieces 55, corresponding to the total number of playing game pieces 20 revealed, are randomly selected, three each from the range of playing game pieces 20 allocated to each panel 25.

Drawing fewer winning game pieces 55 than the number of revealed playing game pieces 20 reduces the probability of getting a winning line L. Similarly, drawing more winning game pieces 55 than the number of revealed playing game pieces 20 increases the probability of getting a winning line L. Therefore, the actual number of winning game pieces 55 that are drawn during a drawing event should be determined statistically to generate odds that induce participation. Similarly, the probability of getting a winning line L is reduced when the population of game pieces allocated to a particular panel 25 is made larger. Thus, while any size population is possible, population size for a particular panel 25 also should be determined statistically to generate odds that induce participation while providing adequate return to the lottery sponsor or owner.

Figure 4:
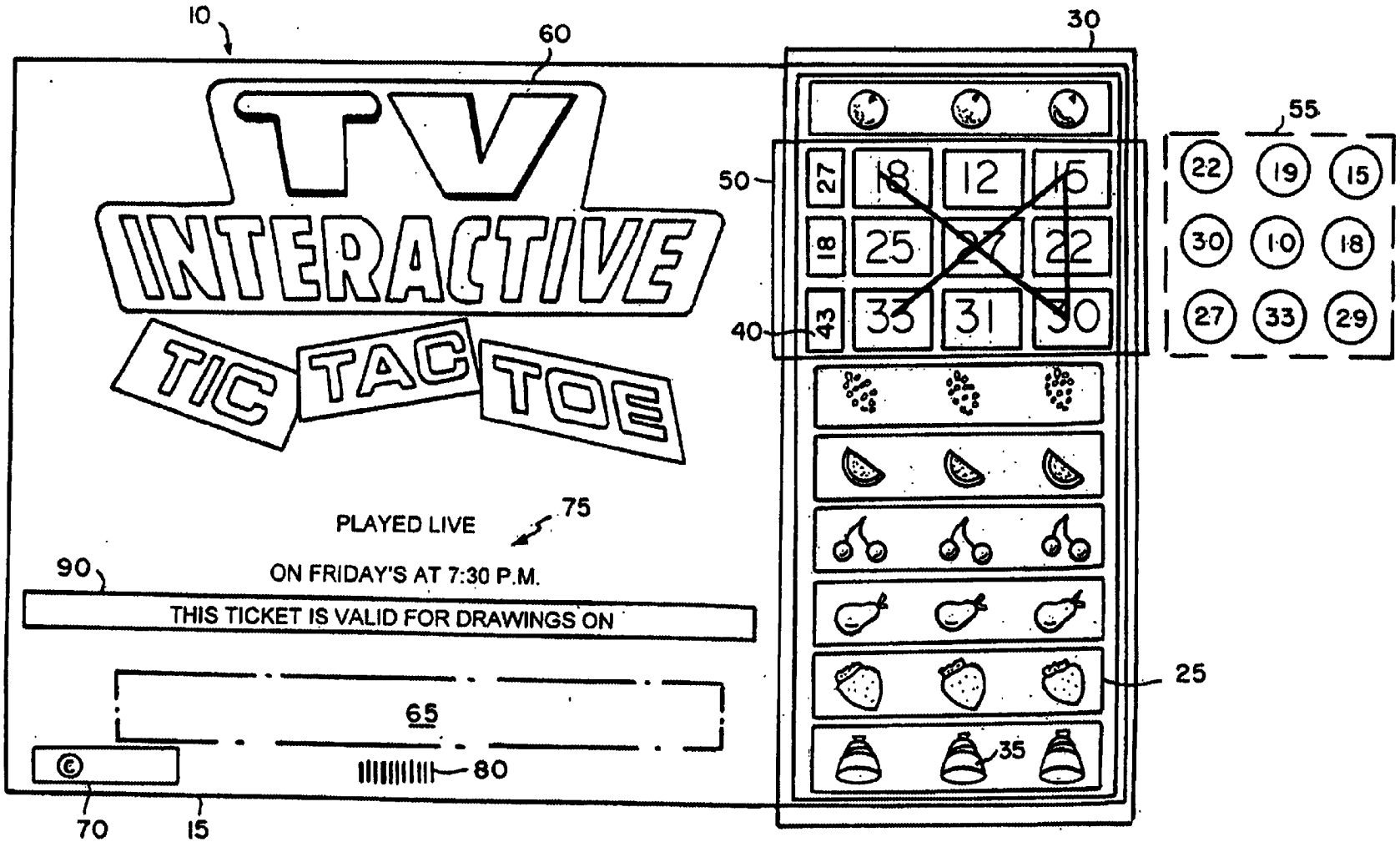
FIG. 4 is an illustrative embodiment of winning lines in a playing panel.

Winning a prize in the game is based on the principle of tic-tac-toe, i.e., "three-in-a-row". Hence, a game ticket 10 can be a-winning game ticket 10 if a game participant's playing panel 50 includes at least one, e.g., horizontal, vertical and/or diagonal, line L that comprises a plurality of, but at least three, adjoining playing game pieces 20 that match some or all of the winning game pieces 55. Playing game pieces 20 in the playing panel 50 are compared to the combination of winning game pieces 55 to determine whether a particular game ticket 10 has one or more winning lines L. Prizes, e.g., cash, are awarded for each winning line L. The greater the number of winning lines L, the larger the prize that is awarded. For example, as shown in FIG. 4, playing panel 50 game pieces 20 corresponding to integers 15, 18, 22, 27, 30, and 33 match some of the winning game pieces 55 to produce three winning lines $L_1$, $L_2$, and $L_3$.

Participants with a winning ticket 10 claim their prize by returning to a point of sale and having their playing ticket 10 validated. The validation process ensures that the playing ticket 10 is genuine and not counterfeit and, moreover, that the playing ticket 10 contains one or more winning lines L. Preferably, validation includes comparing the validation symbols 40 corresponding to each of panels 25 in the playing panel 50 and the playing game pieces 20 with the combination of validation symbols 40 for the drawing events that occurred during the life 90 of the playing ticket 10 and with the winning game pieces 55 selected during the appropriate drawing event, respectively.

As described previously, preferably, the validation symbol 40 can be a concealed symbol that is disposed in each panel 25. In another embodiment, the validation symbol can be a bar code comprising black lines or varying thickness of a type that can be read with a, e.g., bar code, reader. In yet another embodiment, the validation symbol can be a preprinted batch control number, which is a number printed on each playing ticket 10 that identifies the "batch", or plurality of games for which the cards are produced, and the individual card from that batch. The latter two embodiments require a server system that can access at least one database, which comprise at least one of the following: a listing of the arrays of playing game pieces 20 of each playing ticket 10, a listing of all of the playing panels 50 for the discrete drawing events during the life 90 of the playing ticket 10, and a listing of all of the winning game pieces 55 selected during each of those discrete drawing events.

Winning game pieces 55 that form winning lines L do not necessarily have to be drawn, however. Indeed, winning game pieces 55 can be based on the results or occurrence of certain, e.g., sporting, events. For example, winning lines L can be based on results of a number of horse races, wherein playing game pieces 20 in a panel 25 correspond to jockey's jersey numbers of the horses that win, place, and show in designated races. In another example, winning lines L can be based on a plurality of baseball, football, basketball and/or hockey scores. Indeed, a virtually endless list of game piece populations can be possible, all of which are within the scope and spirit of the disclosed invention.

Furthermore, the game of the present invention can be played by including one or more free spaces among the playing game pieces 20, which would improve a participant's odds in winning some prize.

In another embodiment, the number of playing game pieces 20 in each panel 25 can be more than three, e.g., four, and/or the number of panels comprising the playing panel 50 can be more than three, e.g., four. Furthermore, the number of playing game pieces 20 and the number of panels 25 comprising the playing panel 50 do not have to be equal. Indeed, the present invention can be practiced with four playing game pieces 20 in each of three panels 25 comprising the playing panel 50, or vice versa without violating the scope and spirit of this disclosure. When the number of playing game pieces 20 and the number of panels 25 comprising the playing panel 50 are dissimilar, then winning lines L can be of two lengths, corresponding to (i) the number of playing game pieces 20 and (ii) to the number of panels 25 in the playing panel 50. Prizes awarded for this embodiment are greater for a winning line L of the longer dimension. For example, if there are four playing game pieces 25 in each panel 25 and there are three panels 25 comprising the playing panel 50, then a greater prize is awarded for the "four-in-a-row" than for the "three-in-a-row".

In yet another embodiment, a single playing ticket 10 can be used to play for more than one drawing event as long as the two drawing events select non-overlapping panels 25 for their playing panels, which is to say that there is at least one panel 25 between each of the two or more playing panels 50. This embodiment further alleviates the wastage and distribution problem associated with "draw"-type lottery tickets.

While a number of embodiments of the invention have been described, it should be obvious to those skilled in the art that other embodiments to and/or modifications, combinations, and substitutions of the present invention are possible, all of which are within the scope and spirit of the disclosed invention

What is claimed is:

1. A method for playing a game of chance, comprising:

receiving a game ticket, wherein the game ticket includes substrate having an obverse and a reverse side, a plurality of playing game pieces, which are disposed on the obverse side in an array, the array including a plurality of panels, the plurality of panels including a number of playing game pieces, and a removable material having a surface that is disposed over so as to conceal the plurality of playing game pieces, wherein a plurality of unique indicia is disposed on the surface of the removable material so that the plurality of unique indicia corresponds to the plurality of panels;

receiving a first drawing event designation, wherein the first drawing event designation includes a designation of a subset of the plurality of panels to be used in game play;

receiving a selection of a plurality of winning game pieces after a participant has received a game ticket, wherein the selection of the winning game pieces is external to the game ticket.

2. The method for playing a game as recited in claim 1, wherein the plurality of playing game pieces comprises a series of integers.

3. The method for playing a game as recited in claim 1, wherein the number of playing game pieces in the plurality of panels is at least three.

4. The method for playing a game as recited in claim 3, wherein the number of playing game pieces in the plurality of panels is three.

5. The method for playing a game as recited in claim 3, wherein the number of playing game pieces in the plurality of panels is four.

6. The method for playing a game as recited in claim 1 further comprising:

revealing all of the plurality of playing game pieces disposed under a combination of playing panels, said combination of playing panels including some but not all of the plurality of panels, wherein said combination of playing panels is unique to each drawing event of a plurality of lottery-type drawing events.

7. The method for playing a game as recited in claim 6, wherein all of the plurality of playing game pieces disposed in at least three of the plurality of panels are revealed.

8. The method for playing a game as recited in claim 7, wherein the at least three of the plurality of panels are consecutive.

9. The method for playing a game as, recited in claim 8, wherein all of the plurality of playing game pieces disposed in three of the plurality of panels are revealed.

10. The method for playing a game as recited in claim 8, wherein all of the plurality of playing game pieces disposed in four of the plurality of panels are revealed.

11. The method for playing a game as recited in claim 1, wherein one or more of the plurality of game pieces comprises a free space.

12. The method for playing a game as recited in claim 1, the method further comprising:

receiving instructions for using the game ticket in conjunction with at least two types of lottery-type drawing events, wherein the instructions are disposed on the ticket;

providing a name of a lottery-type event on the game ticket;

providing a day of the week and time during which the lottery-type drawing event takes place;

providing an indicia of ownership and intellectual property rights of an owner or sponsor of the game;

indicating a playing life of the game ticket on the game ticket, wherein the playing life includes a range of lottery-type drawing event dates where the game ticket may be prayed; and providing a means for authenticating the game ticket.

13. The method for playing a game as recited in claim 12, wherein providing the means for authenticating the game ticket is selected from a group consisting of:

concealing a validation symbol that is disposed on the game ticket, wherein the plurality of panels is associated with a unique verification symbol that is revealed along with the playing game pieces;

coding a validation symbol comprising a plurality of lines of varying thickness that can be read by a reader; wherein said coded validation symbol is unique to the game ticket; and providing a batch control number.

14. The method of claim 1 further comprising:

selecting a plurality of winning game pieces.

15. The method of claim 1 further comprising:

awarding a prize based on the number of winning lines on the game ticket.

16. The method of playing the lottery game of claim 1, further comprising:

receiving a second drawing event designation, wherein the second drawing event designation designates a second subset of the plurality panels for play, wherein the second subset of the plurality of panels are distinct from the subset of panels designated in the first drawing event designation.

17. The method for playing the game of chance of claim 1 wherein receiving a selection of a plurality of winning game pieces includes receiving a selection event designation, wherein the the selection event designation designates at least one event to select the plurality of winning game pieces.

18. The method of in claim 1, wherein the selection of the plurality of winning game pieces is received through multiple drawings of winning game pieces.

19. The method recited in claim 18, wherein the multiple drawings take place within a playing life of a game ticket.

20. A method for facilitating a game of chance comprising:

providing a game ticket, wherein the game ticket includes a substrate, having an obverse and a reverse side, a plurality of playing game pieces, which are disposed on the obverse side of the lottery ticket in an array, the array including a plurality of panels, the plurality of panels including a number of playing game pieces and a removable material having a surface, wherein the removable material is disposed over the plurality of playing game pieces so as to conceal the plurality of playing game pieces, wherein a plurality of unique indicia is disposed on the surface of the removable material so that the plurality of unique indicia corresponds to the plurality of panels;

providing a first drawing event designation, wherein the first drawing event designation includes a designation of the panels to be used in game play;

randomly selecting a plurality of winning game pieces after the game ticket is provided, wherein the random selection is external to the game ticket.

21. The method for facilitating the game of chance of claim 20, further comprising:

providing a second drawing event designation, wherein the second drawing event designation designates a second subset of the plurality of panels for play, wherein the second subset of the plurality of panels are distinct from the subset of panels designated in the first drawing event designation.

22. The method for facilitating the game of chance of claim 20, further comprising:

providing a selection device to select a plurality of winning game pieces.

23. The method for facilitating the game of chance of claim 20, further comprising:

providing a selection event designation, wherein the selection event designation designates at least one event to select the plurality of winning game pieces.

24. The method recited in claim 20, wherein the plurality of winning game pieces are randomly selected in multiple drawings.

25. The method of claim 24, wherein the multiple drawings take place within a playing life of a game ticket.

* * * * *